US011092011B2

(12) United States Patent
Huang

(10) Patent No.: US 11,092,011 B2
(45) Date of Patent: Aug. 17, 2021

(54) PNEUMATIC MOTOR FOR PNEUMATIC TOOLS

(71) Applicant: KAI JIE PNEUMATIC INDUSTRY CO., LTD., Taichung (TW)

(72) Inventor: Shih-Kwang Huang, Taichung (TW)

(73) Assignee: KAI JIE PNEUMATIC INDUSTRY CO., LTD., Taichung (TW)

( * ) Notice: Subject to any disclaimer, the term of this patent is extended or adjusted under 35 U.S.C. 154(b) by 90 days.

(21) Appl. No.: 16/577,869

(22) Filed: Sep. 20, 2019

(65) Prior Publication Data

US 2020/0173283 A1 Jun. 4, 2020

(30) Foreign Application Priority Data

Dec. 3, 2018 (TW) ..... 107143218

(51) Int. Cl.

| | |
|---|---|
| ***F01D 5/00*** | (2006.01) |
| ***F01D 5/02*** | (2006.01) |
| ***F01D 15/06*** | (2006.01) |
| ***F01D 1/06*** | (2006.01) |
| ***F01D 5/04*** | (2006.01) |
| ***B25F 5/02*** | (2006.01) |
| *B24B 47/08* | (2006.01) |

(52) U.S. Cl.

CPC ..... *F01D 5/026* (2013.01); *B25F 5/02* (2013.01); *F01D 1/06* (2013.01); *F01D 5/021* (2013.01); *F01D 5/043* (2013.01); *F01D 15/06* (2013.01); *B24B 47/08* (2013.01)

(58) Field of Classification Search

CPC ..... F01C 21/10; F01C 21/0809; F01C 13/02; F01D 5/026

USPC ..... 173/218, 93.5

See application file for complete search history.

(56) References Cited

U.S. PATENT DOCUMENTS 3,927,956 A * 12/1975 Linthicum ..... F01C 21/04 418/100
4,817,736 A * 4/1989 Ono ..... B25D 11/102 173/93
5,954,141 A * 9/1999 Li ..... B25B 21/00 173/109
6,059,049 A * 5/2000 Lin ..... B25F 5/00 173/218
7,354,260 B1 * 4/2008 Chang ..... F01C 1/3442 173/200
8,215,934 B2 * 7/2012 Edlund ..... F01C 1/3441 418/104

(Continued)

*Primary Examiner* — Andrew M Tecco
*Assistant Examiner* — Eyamindae C Jallow
(74) *Attorney, Agent, or Firm* — Pai Patent & Trademark Law Firm; Chao-Chang David Pai

(57) ABSTRACT

A pneumatic motor for pneumatic tools includes a cylinder provided therein with a vane wheel. A rotating shaft inserted in the vane wheel is provided with a withstanding member and a tightening member, which can push the withstanding member to move toward the vane wheel and tighten the vane wheel with the rotating shaft for avoiding gap between the vane wheel and the rotating shaft. Thus, when outside driving air pushes the vane wheel to rotate, the vane wheel can synchronously drive the rotating shaft to rotate immediately and truly. By so designing, this invention can solve the problems of the conventional pneumatic motor that is likely to cause starting delay, untrue in power transmission and easy to wear.

9 Claims, 6 Drawing Sheets

(56) References Cited

U.S. PATENT DOCUMENTS

| | | | | |
|---|---|---|---|---|
| 10,018,045 | B2 * | 7/2018 | Chang | B25F 5/00 |
| 2009/0255399 | A1 * | 10/2009 | Hung | F01C 13/02 91/471 |

* cited by examiner

PNEUMATIC MOTOR FOR PNEUMATIC TOOLS

BACKGROUND OF THE INVENTION

1. Field of the Invention

This invention relates to a pneumatic motor, particularly to one used for pneumatic tools, such as a pneumatic sanding machine, a pneumatic engraving machine and the like.

2. Description of the Prior Art

A conventional pneumatic tool is generally formed with a housing provided therein with an accommodating chamber and a gas passage communicating with the accommodating chamber. A pneumatic motor is installed in the accommodating chamber and generally formed with a cylinder provided therein with a vane wheel, which is inserted therein with a rotating shaft able to be rotated relative to the cylinder and able to be connected with a work piece, such as a grinding wheel, a sanding machine or a cutting disc. Thus, when the pneumatic tool is started, outside driving gas will get into the cylinder through the gas passage to push the vane wheel to rotate and actuate the rotating shaft to drive the work piece to rotate for carrying out various kinds of pneumatic work.

However, the vane wheel and the rotating shaft of the conventional pneumatic tool are separately designed in order that when the vane wheel is used for a long time and causes wear, a user can disassemble the vane wheel from the rotating shaft by self and replace the vane wheel with a new one. But in a way of separating design, there will form a gap between the vane wheel and the rotating shaft and as a result, the vane wheel cannot truly drive the rotating shaft to rotate and result in loss of power transmission and further, at the moment of starting the pneumatic tool, power delay will occur and wear will increase. Therefore, the inventor of this invention observes the above-mentioned drawbacks and thinks that the pneumatic motor of the conventional pneumatic tool is necessary to be ameliorated and hence devises this invention.

SUMMARY OF THE INVENTION

The objective of this invention is to offer a pneumatic motor for pneumatic tools, able to avoid producing gap between the vane wheel and the rotating shaft and enabling the vane wheel to immediately and truly drive the rotating shaft to rotate synchronously.

The pneumatic motor for pneumatic tools in the present invention includes a cylinder formed with an air chamber, and a vane wheel is received in the air chamber and formed with a shaft hole for a rotating shaft to be inserted therein and further, the vane wheel has its circumferential side fixed with a plurality of blades spaced apart. Furthermore, two sealing covers are respectively provided at locations corresponding to the opposite openings of the air chamber and each sealing cover is provided with a pivot joint portion to be pivotally connected with two ends of the rotating shaft for enabling the rotating shaft to rotate relative to the cylinder. Moreover, the rotating shaft has one end axially bored with a tightening hole and one side radially bored with a withstanding hole communicating with the tightening hole at a location corresponding to the shaft hole of the vane wheel. In addition, the pneumatic motor contains a withstanding member slidably positioned in the withstanding hole and provided with a driven portion at one side facing the withstanding hole and formed with a withstanding portion at another side facing the vane wheel. The pneumatic motor is further provided with a tightening member to be inserted in the tightening hole and formed with an operating portion at one end facing outside of the tightening hole and provided with a driving portion at another end so that a user can operate the operating portion to drive the tightening member to move toward the withstanding member and push the driven portion through the driving portion to have the withstanding member moved toward the vane wheel and pushed out of the withstanding hole to make the withstanding portion withstand the inner wall of the shaft hole.

The pneumatic motor for pneumatic tools of this invention enables a user to operate the operating portion for actuating the tightening member to move toward the withstanding member and push the driven portion via the driving portion to have the withstanding member moved toward the vane wheel and pushed out the withstanding hole to make the withstanding portion resist against the inner wall of the shaft hole. Thus, the vane wheel and the rotating shaft can be close fit to avoid producing gap between the vane wheel and the rotating shaft. By so designing, when outside driving gas drives the vane wheel to rotate, the vane wheel can synchronously drive the rotating shaft to rotate immediately and truly, thus able to solve the problems of a conventional pneumatic motor that is likely to cause starting delay, untrue in power transmission and easy to wear.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
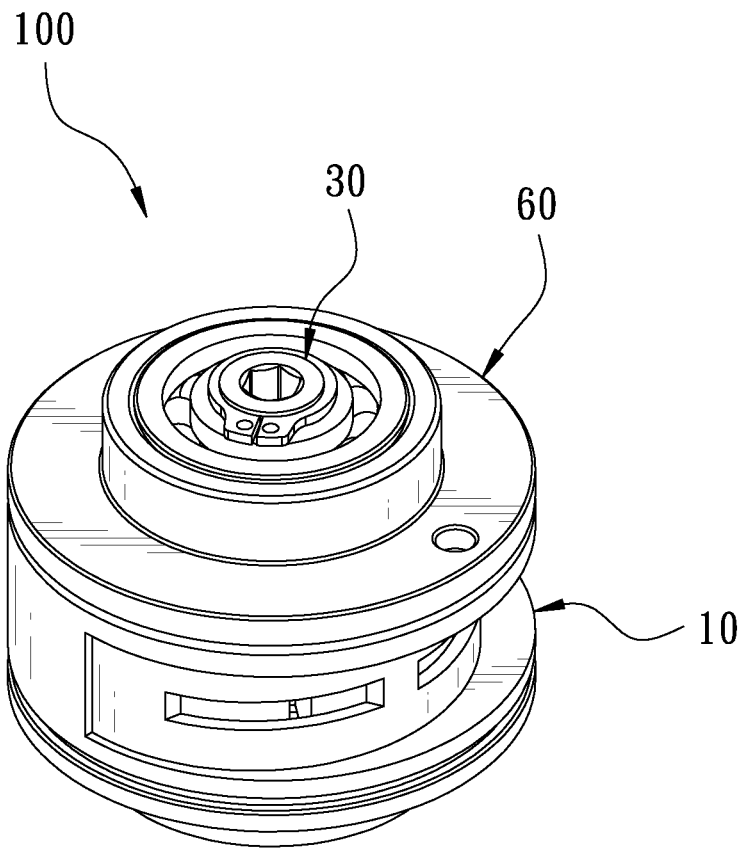
FIG. 1 is a perspective view of a pneumatic motor for pneumatic tools motor in the present invention.
Figure 2:
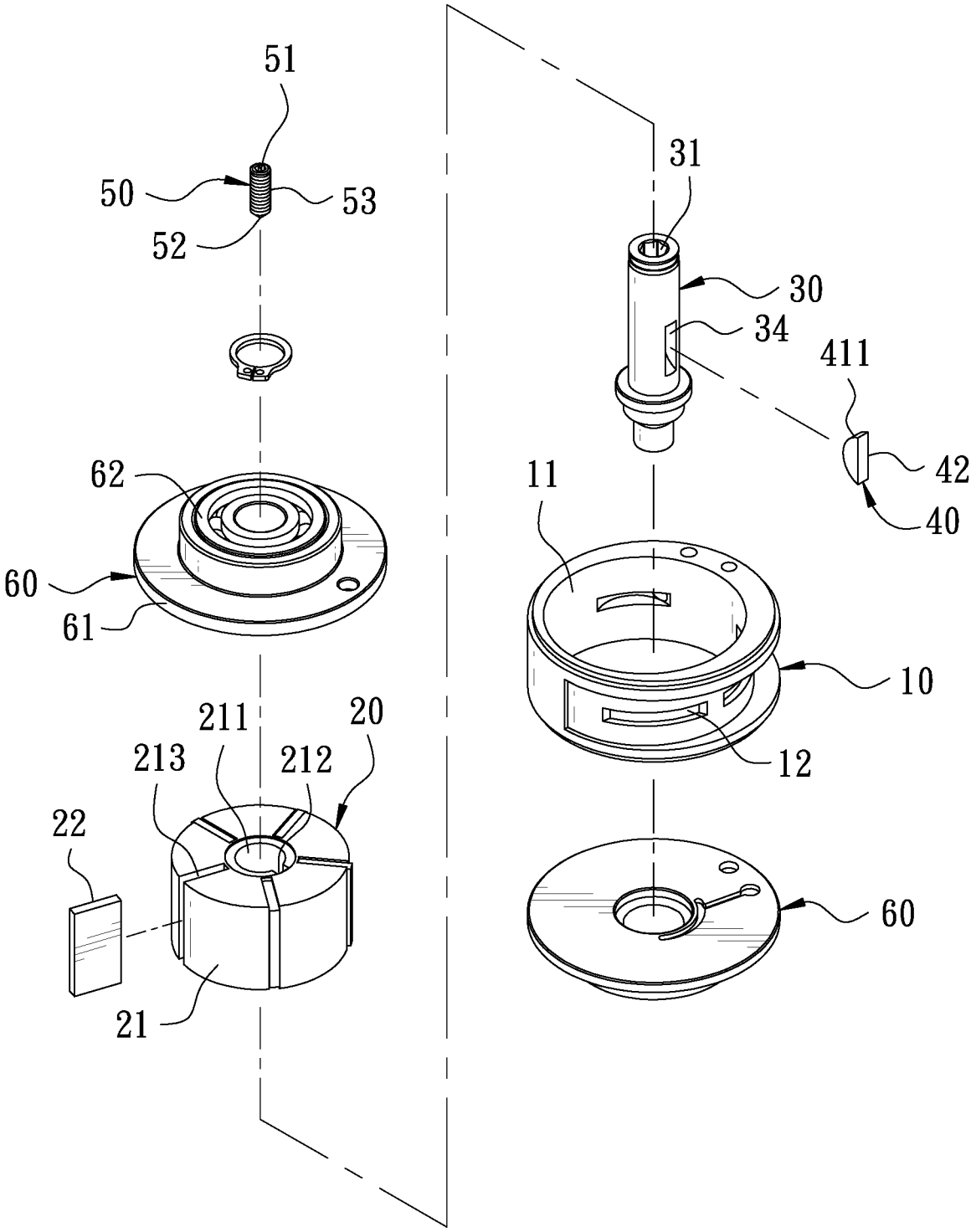
FIG. 2 is an exploded perspective view of the pneumatic motor for pneumatic tools in the present invention.
Figure 3:
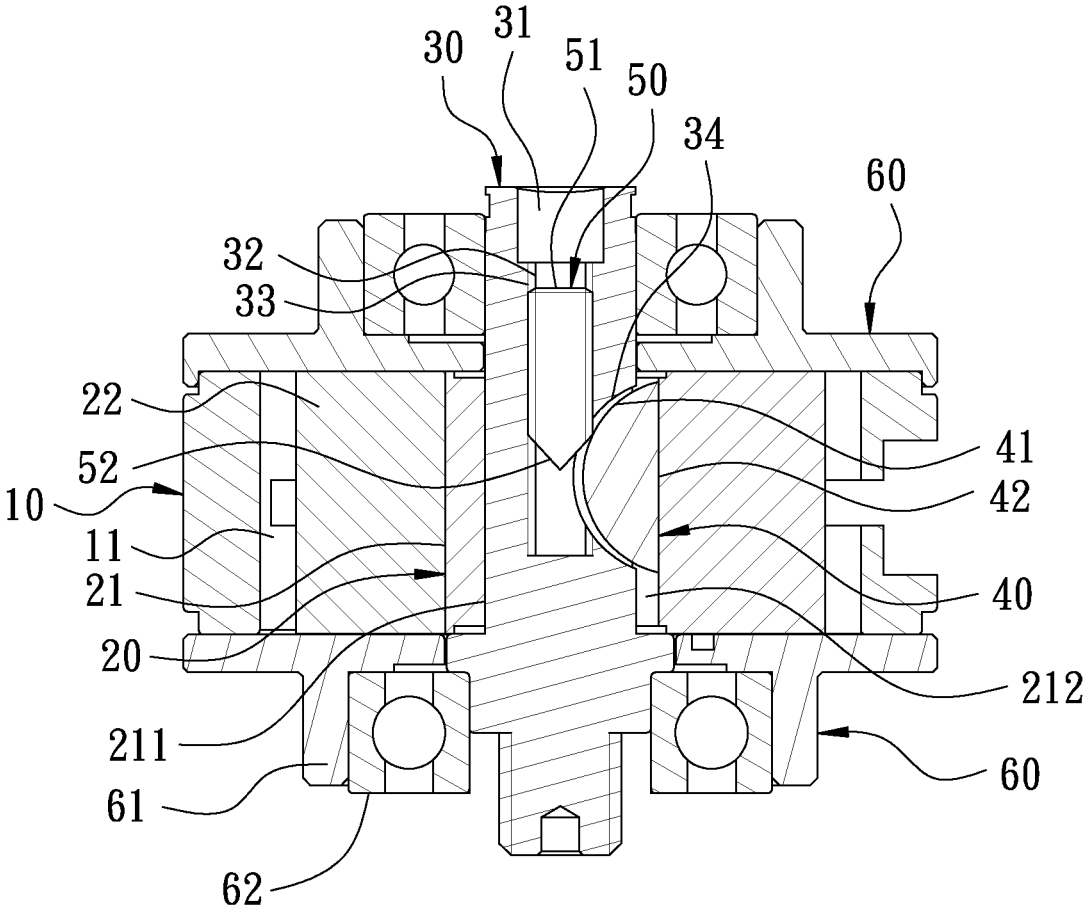
FIG. 3 is a cross-sectional view of the pneumatic motor for pneumatic tools in the present invention.

A preferred embodiment of a pneumatic motor 100 for pneumatic tools in the present invention, as shown in FIGS. 1, 2 and 3, includes a cylinder 10, a vane wheel 20, a rotating shaft 30, a withstanding member 40, a tightening member 50 and two sealing covers 60 as main components combined together.

The cylinder 10 is formed with an air chamber 11 and has its circumferential side bored with a plurality of vent holes 12 communicating with the air chamber 11.

The vane wheel 20 to be received in the air chamber 11 is formed with a main body 21 having a central portion bored with a shaft hole 211, which has an inner wall provided with a recessed groove 212. Further, the main body 21 has its outer circumferential side provided with a plurality of blade grooves 213 spaced apart for installing blades 22 respectively.

The rotating shaft 30 to be inserted in the shaft hole 211 of the vane wheel 20 has one end first provided with a countersink 31 and then has the underside of the countersink 31 axially bored with a tightening hole 32, which is provided with female thread 33. Further, the rotating shaft 30 has one side radially bored with a withstanding hole 34 communicating with the tightening hole 32 at a locating corresponding to the shaft hole 211 of the vane wheel 20.

The withstanding member 40 is slidably received in the withstanding hole 34 of the rotating shaft 30 and formed with a driven portion 41 at one side facing the tightening hole 32 and provided with a withstanding portion 42 at another side facing the vane wheel 20. In this preferred embodiment, the driven portion 41 is a circular cambered surface, which is partially located within the range of the tightening hole 32, while the withstanding portion 42 is a flat surface parallel to the inner wall of the shaft hole 211.

The tightening member 50 is inserted in the tightening hole 32, provided with an operating portion 51 at one end facing outside of the tightening hole 32 and formed with a driving portion 52 at another end. In this preferred embodiment, the tightening member 50 has its circumferential side provided with male threads 53 corresponding with the female thread 33 of the rotating shaft 30 so that the tightening member 50 can be threadably moved up and down in the tightening hole 32. Further, the operating portion 51 is a polygonal hole, while the driving portion 52 is a reverse slope.

The two sealing covers 60 are respectively provided at the opposite sides of the cylinder 10 at the locations corresponding to the openings of the air chamber 11. The sealing covers 60 are respectively formed with a cover body 61, which is bored with an insert hole 611 and provided with a pivot joint portion 62 at a location corresponding to the insert hole 611 to be pivotally connected with the end of rotating shaft 30 to enable the rotating shaft 30 to rotate relative to the cylinder 10. In the preferred embodiment, the pivot joint portion 62 is a bearing, and two ends of the rotating shaft 30 are respectively inserted in the bearings, letting the two ends of the rotating shaft 30 respectively and pivotally connected with the two sealing covers 60.

Figure 4:
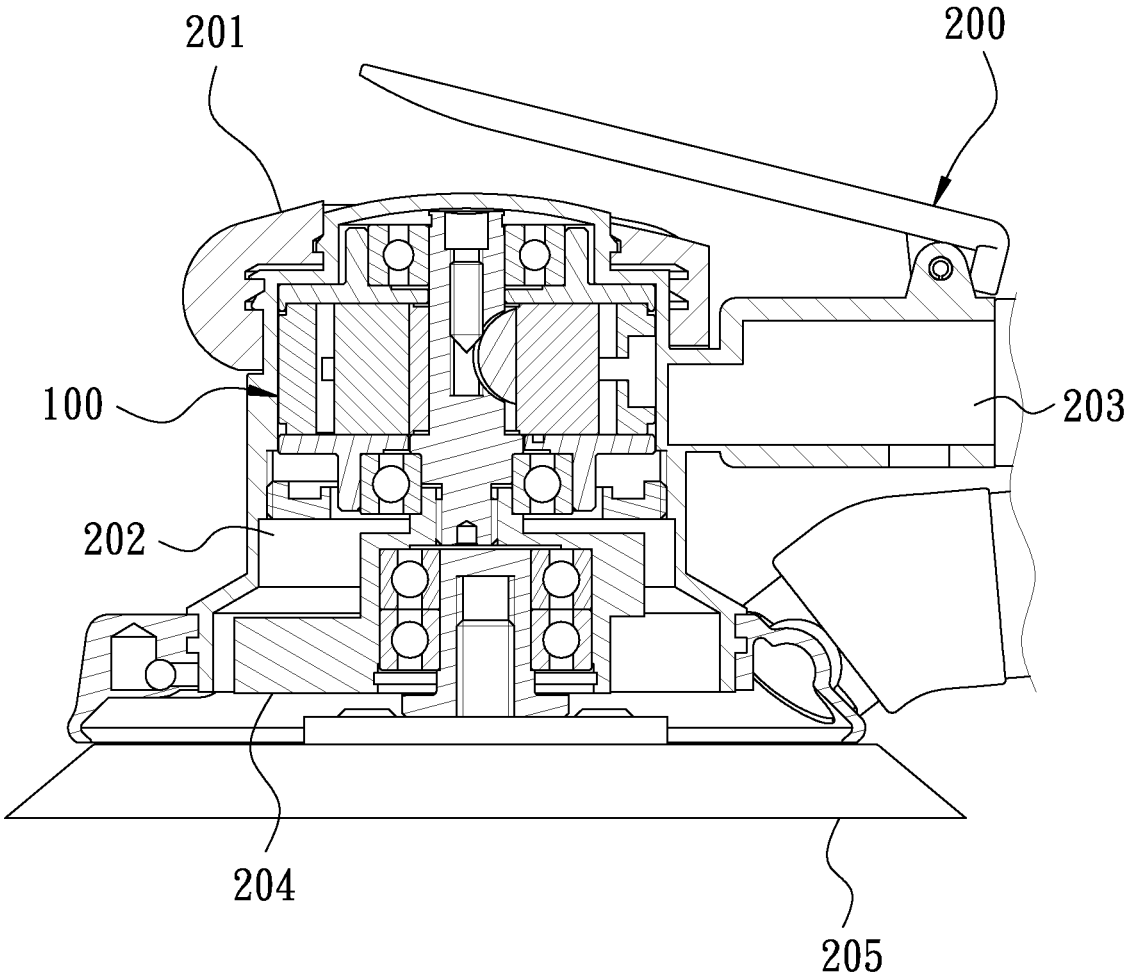
FIG. 4 is a schematic view of the pneumatic motor for pneumatic tools in use in the present invention.

Referring to FIG. 4, the pneumatic motor 100 of this invention can be installed in a pneumatic tool 200, such as a sanding machine, an engraving machine and the like. Taking a sanding machine for instance, the sanding machine is formed with a housing 201 provided therein with an accommodating chamber 202 for receiving the pneumatic motor 100 and formed with a gas passage 203 communicating with the accommodating chamber 202. Further, the pneumatic tool 200 is provided with an eccentric block 204, which has one end connected with the rotating shaft 30 and another end connected with a sanding wheel 205. Thus, outside driving air can get into the accommodating chamber 202 through the gas passage 203 and then, the driving air will pass through the vent holes 12 and get into the air chamber 11 to push the vane wheel 20 to rotate and actuate the rotating shaft 30 to drive both the eccentric block 204 and sanding wheel 205 to rotate, thus attaining the objective of sanding work.

Figure 5:
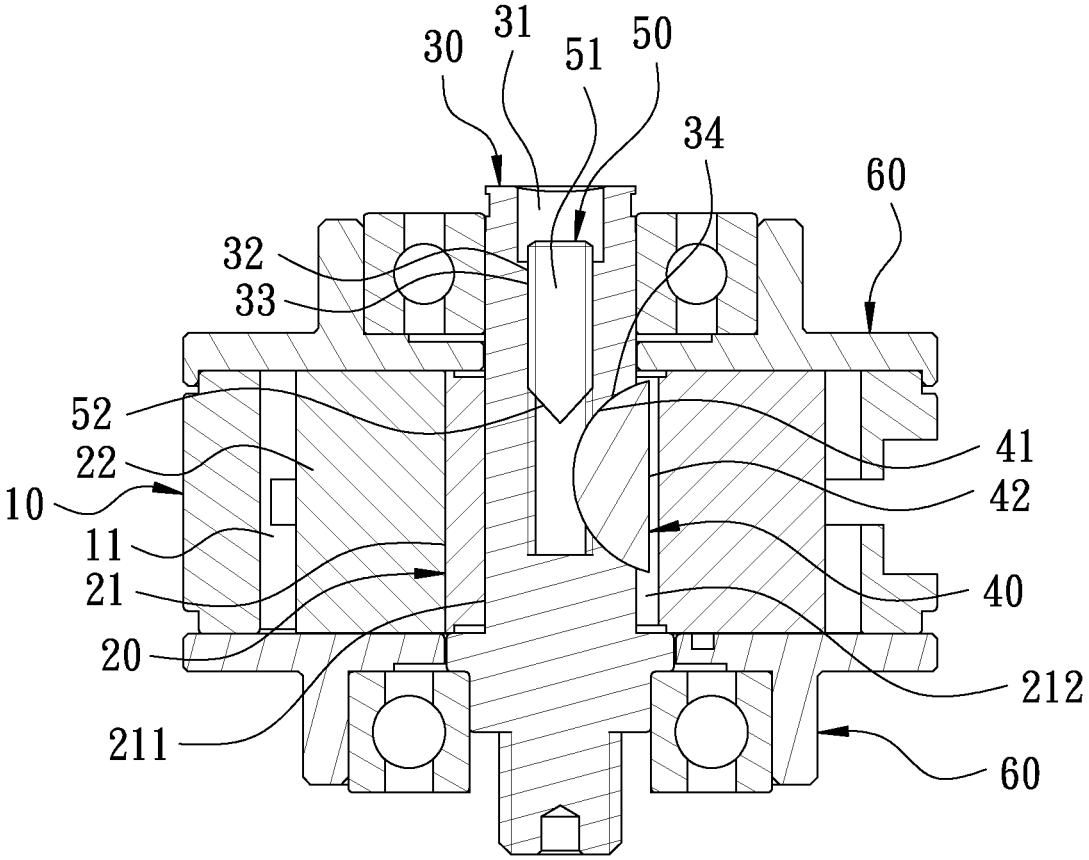
FIG. 5 is a motion schematic view of the pneumatic motor for pneumatic tools in the present invention, showing a state before a vane wheel and a rotating shaft are tightened.
Figure 6:
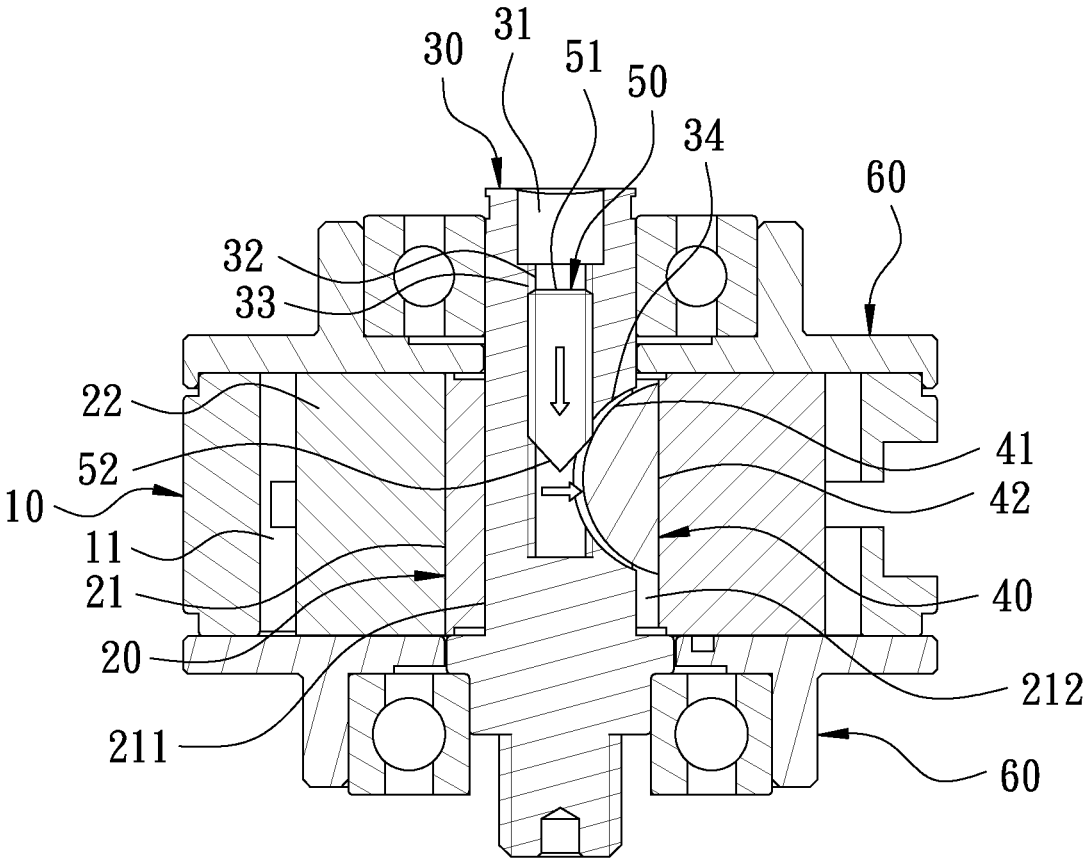
FIG. 6 is another motion schematic view of the pneumatic motor for pneumatic tools in the present invention, showing a state after the vane wheel and the rotating shaft are tightened.

In assembling the pneumatic motor 100, referring to FIGS. 5 and 6, firstly the withstanding member 40 is slidably received in the withstanding hole 34 of the rotating shaft 30. Next, the rotating shaft 30 is inserted in the shaft hole 211 of the vane wheel 20 and then, the tightening member 50 is inserted into the tightening hole 32, and a polygonal tool like a hexagonal wrench is used to drive the operating portion 51 for actuating the tightening member 50 to move toward the withstanding member 40. At this time, referring to FIG. 6, the tightening member 50, through wedge action between the circular cambered surface and the reverse slope, can actuate the driving portion 52 to push the driven portion 41 to have the withstanding member 40 moved toward the vane wheel 20 and pushed out of the withstanding hole 34, letting the withstanding portion 42 withstand the recessed groove 212 of the vane wheel 20. Thus, the vane wheel 20 and the rotating shaft 30 can be close fit and gap between the vane wheel 20 and the rotating shaft 30 can be prevented. By so designing, when outside driving air pushes the vane wheel 20 to rotate, the vane wheel 20 can synchronously drive the rotating shaft 30 to rotate immediately and truly, thus able to solve the problems of the conventional pneumatic motor that is likely to cause starting delay, untrue in power transmission and easy to wear.

What is worth mentioning is that the vane wheel 20 and the rotating shaft 30 is close fit through foresaid structure; therefore, the diameter of the shaft hole 211 can be slightly larger than that of the rotating shaft 30. Thus, when the vane wheel 20 causes wear and needs to be replaced, a user needs only to drive the operating portion 51 to actuate the tightening member 50 to move away from the withstanding member 40 to let the driving portion 52 to move away from the driven portion 41 and enable the withstanding member 40 to be concealed in the withstanding hole 34, letting the withstanding portion 42 moved away from the inner wall of the shaft hole 211 of the vane wheel 20. Thus, the vane wheel 20 can easily be removed from the rotating shaft 30 and replaced, easy to attain effect of maintenance.

One special feature of this invention is that the rotating shaft 30 has one end first provided with the recessed countersink 31 and then has the underside of the countersink 31 axially bored with the tightening hole 32 and subsequently has the interior of the tightening hole 32 forming the female thread 33 by means of tapping tools. Compared with a way of direct drilling and tapping, this way can greatly reduce tapping depth and lower difficulty and cost of tapping.

While the preferred embodiment of the invention has been described above, it will be recognized and understood that various modifications may be made therein and the appended claims are intended to cover all such modifications that may fall within the spirit and scope of the invention.

What is claimed is:

1. A pneumatic motor for pneumatic tools comprising a cylinder, said cylinder provided with an air chamber, said air chamber installed therein with a vane wheel, said vane wheel formed with a shaft hole for receiving a rotating shaft therein, said vane wheel having a circumferential side provided with a plurality of blades spaced apart, said cylinder having two sealing covers respectively covered at opposite openings of said air chamber, said sealing covers respectively provided with a pivot joint portion to be respectively and pivotally connected with two ends of said rotating shaft to enable said rotating shaft to rotate relative to said cylinder, and characterized by said rotating shaft having one end bored with a tightening hole and said rotating shaft having one side radially bored with a withstanding hole communicating with said tightening hole at a location corresponding to said shaft hole of said vane wheel;

a withstanding member slidaby received in said withstanding hole, said withstanding member formed with a driven portion at one side facing said tightening hole, said withstanding member provided with a withstanding portion at one side facing said vane wheel; and a tightening member inserted in said tightening hole, said tightening member provided with an operating portion at one end facing outside of said tightening hole, said tightening member formed with a driving portion at another end, a user able to operate said operating portion to actuate said tightening member to move toward said withstanding member, said driven portion pushed by said driving portion to have said withstanding member moved toward said vane wheel and pushed out of said withstanding hole, letting said withstanding portion withstand an inner wall of said shaft hole.

2. The pneumatic motor for pneumatic tools as claimed in claim 1, wherein said driven portion is a circular cambered surface and said driving portion is a reverse slope so that said tightening member, through wedge action between said circular cambered surface and said reverse slope, can make said withstanding member moved toward said vane wheel and pushed out of said withstanding hole.

3. The pneumatic motor for pneumatic tools as claimed in claim 1, wherein tightening hole is provided with female thread in the interior, and said tightening member is provided with corresponding male thread to enable said tightening member to be threadably moved in said tightening hole.

4. The pneumatic motor for pneumatic tools as claimed in claim 1, wherein said rotating shaft has one end first provided with recessed countersink and then has an underside of said countersink bored with said tightening hole.

5. The pneumatic motor for pneumatic tools as claimed in claim 1, wherein said withstanding portion is a flat surface parallel to an inner wall surface of said shaft hole.

6. The pneumatic motor for pneumatic tools as claimed in claim 1, wherein said shaft hole of said vane wheel has an inner wall bored a recessed groove, and said withstanding portion of said withstanding member is to resist said recessed groove.

7. The pneumatic motor for pneumatic tools as claimed in claim 1, wherein said operating portion of said tightening member is a polygonal hole.

8. The pneumatic motor for pneumatic tools as claimed in claim 1, wherein said pivot joint portion of each of said sealing covers is a bearing and said two ends of said rotating shaft are respectively inserted in said bearings of said sealing covers.

9. The pneumatic motor for pneumatic tools as claimed in claim 1, wherein a diameter of said shaft hole is slightly larger than that of said rotating shaft.

* * * * *